US010240318B2

(12) United States Patent
Dennis et al.

(10) Patent No.: US 10,240,318 B2
(45) Date of Patent: Mar. 26, 2019

(54) BOOM ASSEMBLY OF MACHINE

(71) Applicant: Caterpillar Inc., Peoria, IL (US)

(72) Inventors: Clyde R. Dennis, Dunlap, IL (US); Stephen P. Rutherford, Edwards, IL (US)

(73) Assignee: Caterpillar Inc., Deerfield, IL (US)

( * ) Notice: Subject to any disclaimer, the term of this patent is extended or adjusted under 35 U.S.C. 154(b) by 31 days.

(21) Appl. No.: 15/374,367

(22) Filed: Dec. 9, 2016

(65) Prior Publication Data

US 2018/0163362 A1 Jun. 14, 2018

(51) Int. Cl.
*E02F 3/38* (2006.01)
*E02F 9/26* (2006.01)

(52) U.S. Cl.
CPC ..... *E02F 3/38* (2013.01); *E02F 9/267* (2013.01)

(58) Field of Classification Search
USPC ..... 414/727, 806; 52/223.1, 223.14
See application file for complete search history.

(56) References Cited

U.S. PATENT DOCUMENTS 2,055,111 A 9/1936 Siebert
2,610,754 A * 9/1952 Inskeep ..... E02F 3/38 414/727
2,770,372 A 11/1956 Martinson
3,181,881 A * 5/1965 Van Raden ..... B60D 1/155 280/142
4,193,734 A * 3/1980 Williams ..... E02F 3/30 212/347
5,301,482 A * 4/1994 Aspenwall ..... E04C 3/10 312/140
5,316,709 A * 5/1994 Ko ..... B29C 70/347 156/172
6,062,527 A * 5/2000 Nygren, Jr. ..... B64G 1/222 248/591
2011/0002765 A1 1/2011 Asam et al.

FOREIGN PATENT DOCUMENTS

CN 103332610 A 10/2013

* cited by examiner

*Primary Examiner* — Ronald P Jarrett
(74) *Attorney, Agent, or Firm* — Leydig, Voit & Mayer, Ltd.

(57) ABSTRACT

The present disclosure provides a load carrying member for a machine. The load carrying member includes an outer shell, an inner shell disposed within the outer shell. The inner shell is pre-stressed. The load carrying member also includes a pin disposed through the outer shell and in contact with the inner shell to add stress to the inner shell during operation of the machine.

19 Claims, 7 Drawing Sheets

BOOM ASSEMBLY OF MACHINE

TECHNICAL FIELD

The present disclosure relates to a boom assembly of a machine and more particularly to a load carrying member of the boom assembly.

BACKGROUND

Machines, such as hydraulic excavators and hydraulic shovels, perform work at a work site. Among the work performed, the machines are employed to raise a load from a loading location and dump the load at a dumping location. For the purpose of handling such a load, the machines employ a work tool, such as a bucket, coupled to a boom assembly via a stick of the machine. The boom assembly includes a boom coupled to the stick and multiple hydraulic actuators to enable pivotal movement of the stick. Further, the boom is pivotally coupled to a frame of the machine to allow travel of the work tool to a desired height or depth. Typically, the boom is formed from steel. Although steel provides structural stability to the boom, steel renders the boom heavy. In cases where the machine includes a long boom, the weight of the boom may be higher than desired. In addition, such a long boom may often be subjected to dipping, where the frame of the machine tends to lift from ground surface when the boom lifts heavy loads. As such, the weight of the boom becomes detrimental to operation of the machine, thereby restricting optimization of boom design. Further, when different operations of the machine create different loads, it would be desirable to modify the ability of the boom to accommodate to the different loads.

Chinese Patent Application Number 103332610 describes a connection structure of an end part of a cantilever, which is made of carbon-fiber composite materials. The connection structure is formed by successive adhesion of metal and carbon-fiber, where a metal internal layer is the inner part, a metal outside plate is the outer part, and a carbon-fiber enhanced layer is arranged between the inner part and the outer part. The metal internal layer and the metal outside plate are connected by welding, and form a sandwich structure. The metal inner layer includes a long metal tube, two short metal tubes, and a frame. One end of the frame is provided with a square component, and the other end of the frame is provided with a U-shaped connector.

SUMMARY OF THE DISCLOSURE

In one aspect of the present disclosure, a load carrying member for a machine is provided. The load carrying member includes an outer shell and an inner shell disposed within the outer shell. The inner shell is disposed within the outer shell and configured according to a predetermined curvature, whereby the inner shell is pre-stressed. A pin is disposed through the outer shell and in contact with the inner shell and configured to increase a spring rate of the inner shell.

In another aspect of the present disclosure a machine is provided that includes a frame and a boom assembly coupled to the frame. The boom assembly includes a work tool. A stick is coupled to the work tool. A load carrying member has a first end coupled to the frame and a second end coupled to the stick. The load carrying member includes an outer shell and an inner shell disposed within the outer shell, wherein the inner shell is pre-stressed. A pin is disposed through the outer shell and in contact with the inner shell and configured to increase a spring rate of the inner shell.

Further and alternative aspects and features of the disclosed principles will be appreciated from the following detailed description and the accompanying drawings. As will be appreciated, the principles related to load carrying members work machines disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
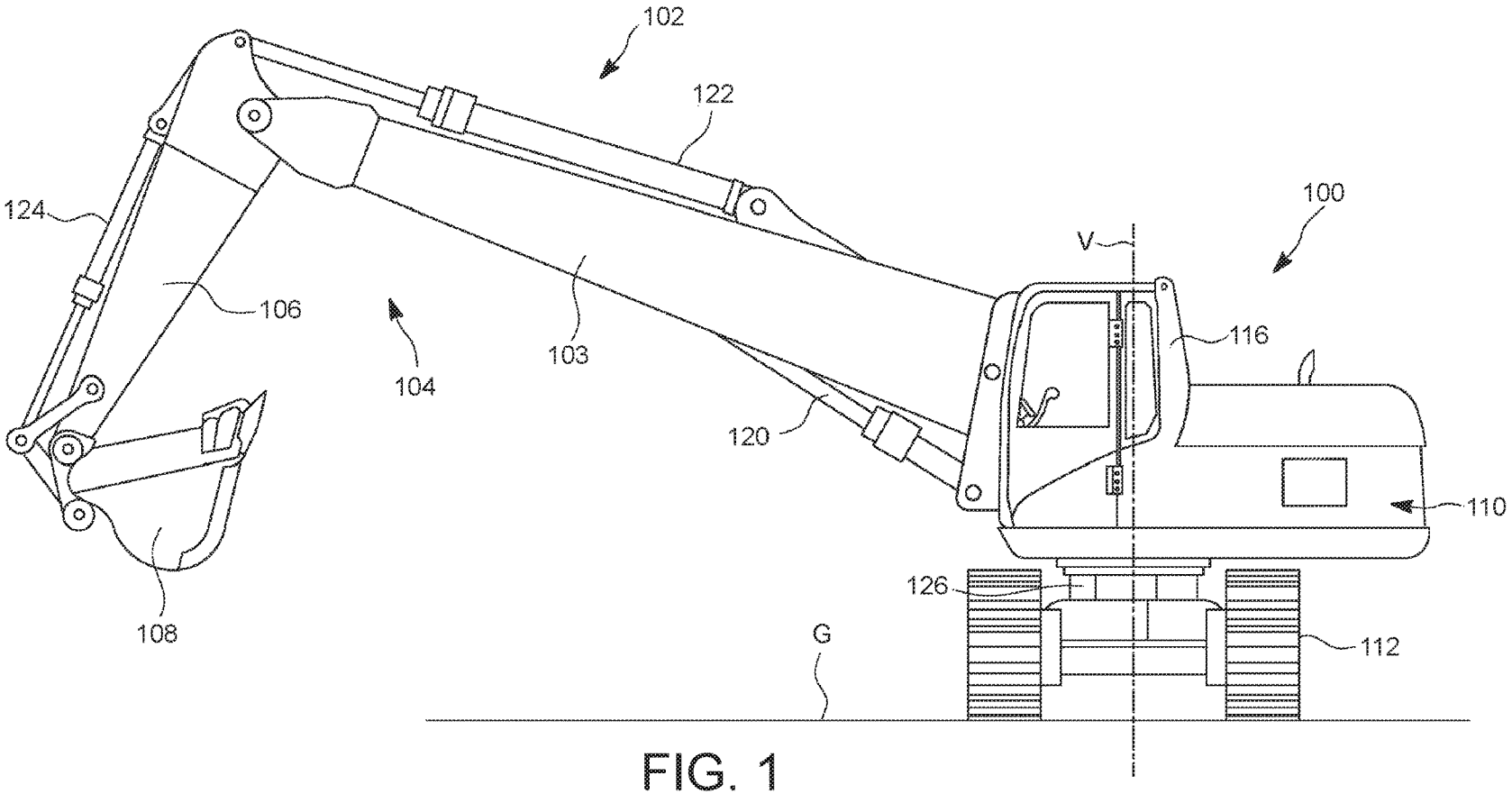
FIG. 1 is a side view of a machine equipped with a boom assembly having a load carrying member, according to an embodiment of the present disclosure.

FIG. 1 illustrates a side view of a machine 100 equipped with a boom assembly 102, according to an embodiment of the present disclosure. In one embodiment, the machine 100 is a hydraulic excavator. However, in some embodiments, the machine 100 may be embodied as a hydraulic mining shovel, a material handler, or a crane, for example.

The boom assembly 102 includes a load carrying member 104 and a work tool 108. The load carrying member 104 is pivotally connected to a frame 110 of the machine 100 and the work tool 108 is pivotally connected to the load carrying member 104. A boom 103 and a stick 106 constitute the load carrying member 104 of the machine 100. Load carried by the work tool 108 is distributed between the boom 103 and the stick 106.

The machine 100 also includes a drive unit 112, such as tracks and wheels, for propelling the machine 100 over a ground surface 'G', a power source 114 to power the boom assembly 102 and the drive unit 112, and an operator cabin 116 for hosting user interface devices that aid in controlling the boom assembly 102 and the drive unit 112. The power source 114 may embody an engine, such as a diesel engine, a gasoline engine, a gaseous fuel-powered engine, or any other type of combustion engine known in the art. The power source 114 may alternatively embody a non-combustion source of power, such as a fuel cell and a power storage device. The power source 114 may produce mechanical or electrical power output that may then be converted to hydraulic power for moving the boom assembly 102 and the work tool 108.

Further, a movement of the work tool 108 includes raising and lowering the load carrying member 104 with respect to the frame 110, moving the stick 106 inward and outward with respect to the operator cabin 116, and rotating the work tool 108 relative to the stick 106. The load carrying member 104 may be raised and lowered by a first hydraulic actuator 120. The stick 106 may be moved toward and outward with respect to the operator cabin 116 by a second hydraulic actuator 122. In addition, a third hydraulic actuator 124 is used to curl and uncurl the work tool 108 relative to the stick 106. Furthermore, the frame 110 and the boom assembly 102 may be rotated about a vertical axis 'V', with respect to the drive unit 112, by a fourth hydraulic actuator 126, such as a hydraulic motor.

Figure 2:
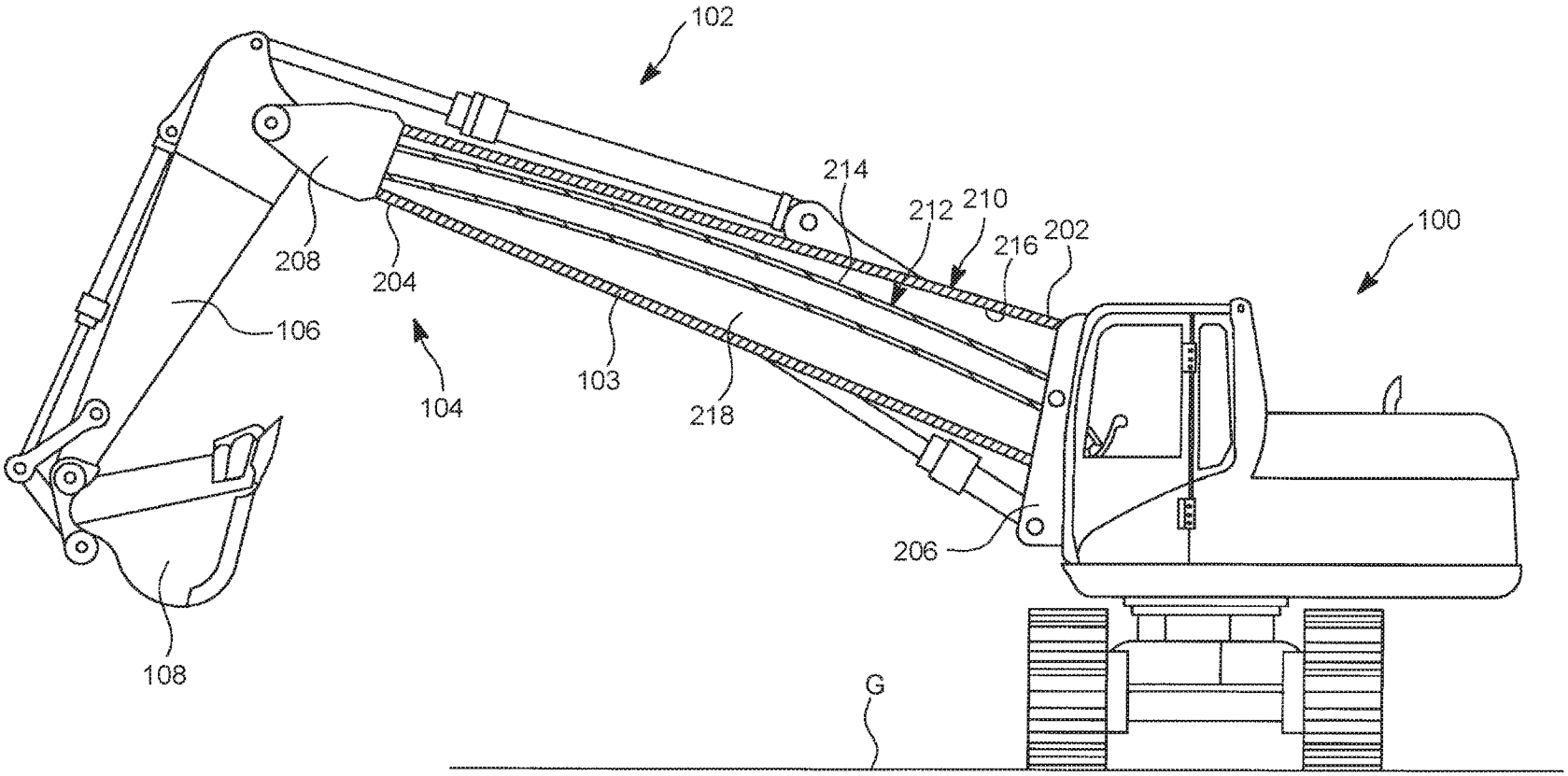
FIG. 2 is a side view of the machine of FIG. 1 showing a partial cross-section view of the load carrying member having an inner shell disposed in an outer shell of the load carrying member, according to an embodiment of the present disclosure.

FIG. 2 illustrates a partial cross-section view of the machine 100. Specifically, FIG. 2 illustrates a cross-section of the load carrying member 104 of the machine 100, according to one embodiment of the present disclosure. The load carrying member 104 includes a first end 202 and a second end 204. Each of the first end 202 and the second end 204 includes an attachment fixture configured to couple the load carrying member 104 to the frame 110 and the stick 106, respectively. As illustrated in FIG. 2, the first end 202 includes a first attachment fixture 206 and the second end 204 includes a second attachment fixture 208. The first attachment fixture 206 and the second attachment fixture 208 can be embodied as, but not limited to, brackets that aid in coupling of the load carrying member 104 to the frame 110 and the stick 106, respectively.

The load carrying member 104 includes an outer shell 210. In one embodiment, the cross-section of the outer shell 210 can be a rectangle. In other embodiments, the cross-section of the outer shell 210 can include one of a polygon, a circle, and an ellipse. In order to have better structural stability, the outer shell 210 should be formed from materials which provide a high degree of strength. Accordingly, in an example, material of the outer shell 210 may include, but not limited to, at least one of high speed steel (HSS) and carbon fibers. The first end 202 and the second end 204 correspond to a first end and a second end of the outer shell 210. As such, the first attachment fixture 206 and the second attachment fixture 208 are provided at the ends of the outer shell 210.

The load carrying member 104 further includes an inner shell 212 disposed within the outer shell 210. Such configuration of the inner shell 212 disposed within the outer shell 210 is illustrated with respect to the boom 103 only for the purpose of description and should not be construed as a limitation. In one embodiment, the inner shell 212 and the outer shell 210 configuration can be implemented in the stick 106. In another embodiment, the inner shell 212 and the outer shell 210 configuration can be implemented in both the stick 106 and the boom 103. Further, it will be appreciated that the inner shell 212 and the outer shell 210 configuration described in the present disclosure can be implemented in any front structures of the machine 100 that are capable of extending away from the frame 110 of the machine 100.

In one embodiment, the cross-section of the inner shell 212 can be circular. In other embodiments, the cross-section of the inner shell 212 can include one of a rectangle, a polygon, and an ellipse. The first attachment fixture 206 and the second attachment fixture 208 can be configured to couple to ends of the inner shell 212. In one embodiment, the first attachment fixture 206 and the second attachment fixture 208 can be embodied as metal plates configured to couple to the ends of the inner shell 212. In the preferred embodiment, the inner shell 212 is pre-stressed prior to introducing the inner shell 212 into the outer shell 210. Selection of materials for the inner shell 212 and pre-stressing process is performed in a manner, such that the inner shell 212 acquires a spring rate post the pre-stressing process. As such, the inner shell 212 would be capable of springing back to its original condition, which is straight condition, when the inner shell 212 is subjected to bending loads. In an example, the inner shell 212 may be composed of shape memory polymers. In another example, material disposed between the inner shell 212 and the outer shell 210 can be a shape changing fluid, such as a magnetorheological fluid (MR fluid).

In one embodiment, the inner shell 212 has an inner shell length that is greater than an outer shell length of the outer shell 210. In such a condition, the inner shell 212 is caused to be bent at a predetermined curvature when the inner shell 212 is disposed within the outer shell 210 and between the first attachment fixture 206 and the second attachment fixture 208. In one case, the inner shell 212 can be bent in a manner, such that the inner shell 212 is concave towards the work tool 108, as shown in FIG. 2. The load carrying member 104 further includes a polymer composite 218 disposed between an outer surface 214 of the inner shell 212 and an inner surface 216 of the outer shell 210, as shown in FIG. 2. In an example, the polymer composite 218 may be a Sandwich Plate Steel (SPS) polymer or a thermosetting polymer. The polymer composite 218 can be heated to a predefined temperature and can be filled in a cavity formed between the outer surface 214 of the inner shell 212 and the inner surface 216 of the outer shell 210. Subsequently, the polymer composite 218 is allowed to settle and cool down. The polymer composite 218 provides a stiffness required for the operation of the load carrying member 104.

Figure 3:
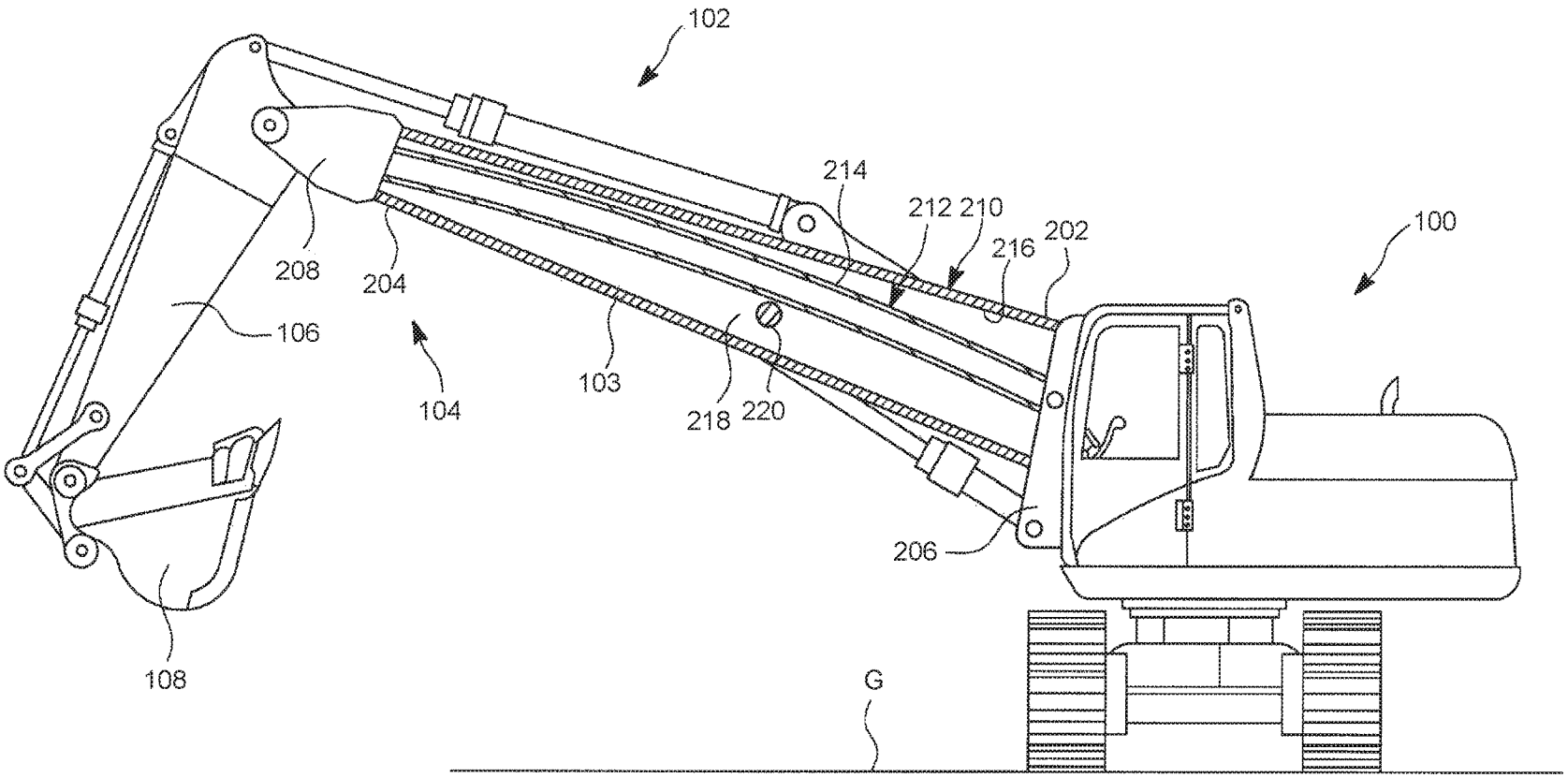
FIG. 3 is a side view of the machine of FIG. 1 including a fixed pin disposed in contact with the inner shell.

The embodiment illustrated in FIG. 3 includes a pin 220 fixed through the outer shell 210 of the boom 103. The pin 220 may be cylindrical or rod-shaped or any suitable shape capable of adding stress to the inner shell 212. The pin 220 may be made of any suitable high strength material, such as steel, aluminum, and composites. The pin 220 is attached to the outer shell 210 of the boom 103 and may extend transversely through or across the interior of the boom in a position contacting and supporting the inner shell 212. The pin 220 may be disposed underneath the inner shell 212 and is positioned to add additional stress to the pre-stressed inner shell 212. Underneath refers to the underside of the inner shell 212 defined during normal upright operation of the machine 100. Further, the pin 220 may be disposed about midway between the first and second attachment fixtures 206, 208. Thus, during operation of the machine 100, loads are carried by the boom 103 and the inner shell 212, which inner shell is further stressed and supported by the pin 220. Since the pin 220 is fixed in position, the inner shell 212 has a fixed amount of stress added by the pin in any one position of the boom 103.

Figure 4:
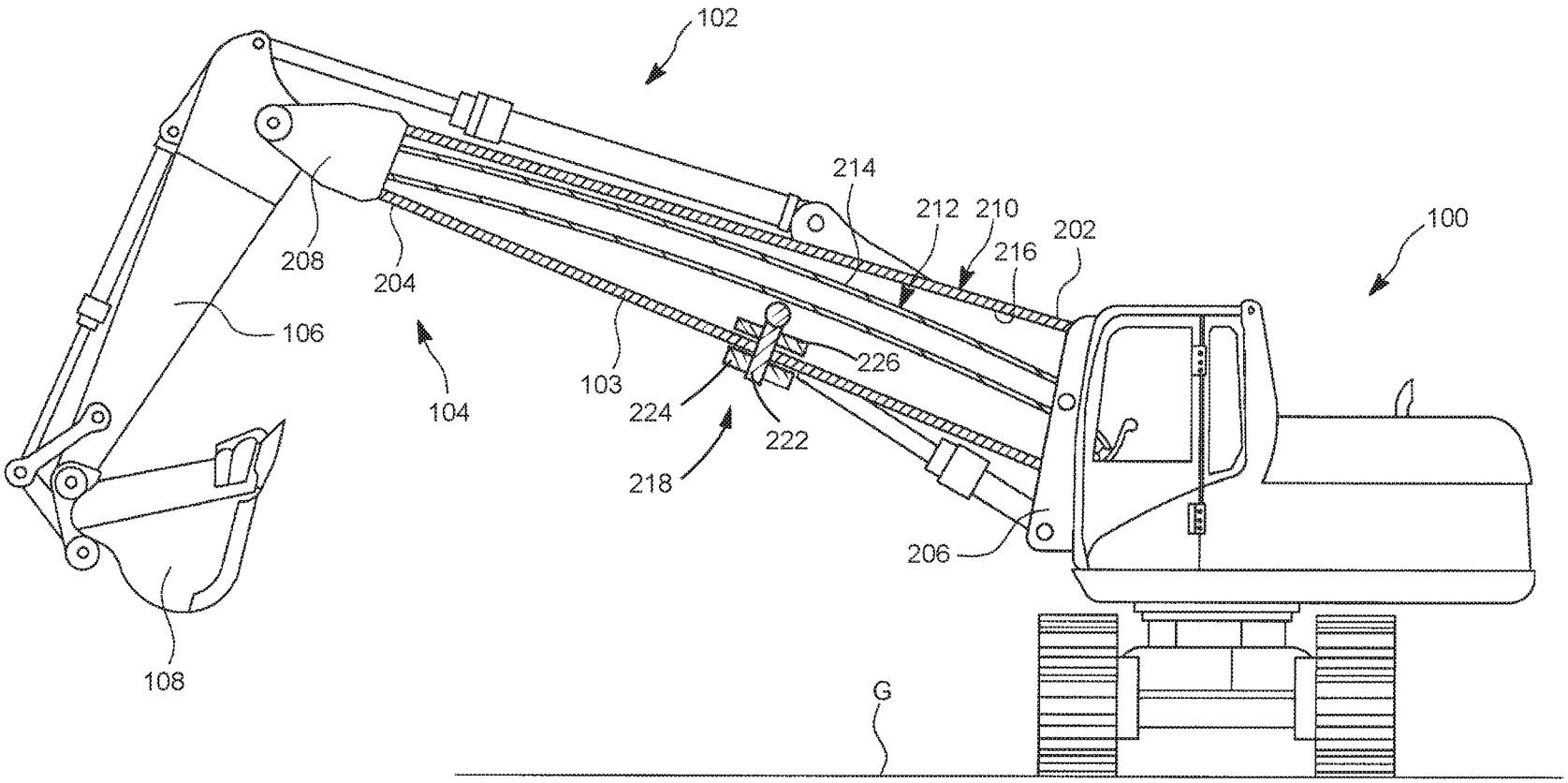
FIG. 4 is a side view of the machine of FIG. 1 including a movable pin disposed in contact with the inner shell.

FIG. 4 illustrates a cross-section of the load carrying member 104 of the machine 100, according to another embodiment of the present disclosure. As illustrated in FIG. 4, the machine 100 includes much of the same construction as in the previous embodiment. However, the present embodiment of the machine 100 includes a movable pin 222. The movable pin 222 may be mounted so as to be in contact with an underside of the inner shell 212. In this respect, the movable pin 222 may function like the fixed pin 220 shown in FIG. 3. The movable pin 222 may be selectively moved more inwardly of the boom 103 and thus, apply a relatively increased amount of stress to the inner shell 212, or outwardly to apply a relatively reduced amount of stress to the inner shell. In one embodiment, the movable pin 222 passes through an outer block 224, disposed and attached outside the outer shell 210 of the boom 103 and passes through an inner block 226, disposed inside the outer shell of the boom. The movable pin 222 may be threadably engaged with the outer block and/or the inner block 224, 226. Rotating the movable pin 222 in the blocks 224, 226, causes the movable pin to be urged, by way of the threaded engagement, in or out of the boom 103 depending on the pitch of the threads of the threaded engagement. Moving the movable pin 222 inwardly increases the stress on the inner shell 212 and conversely, moving the movable pin outwardly reduces the stress added to the inner shell. Other mechanisms are contemplated for changing the position of the movable pin 222.

Figure 5:
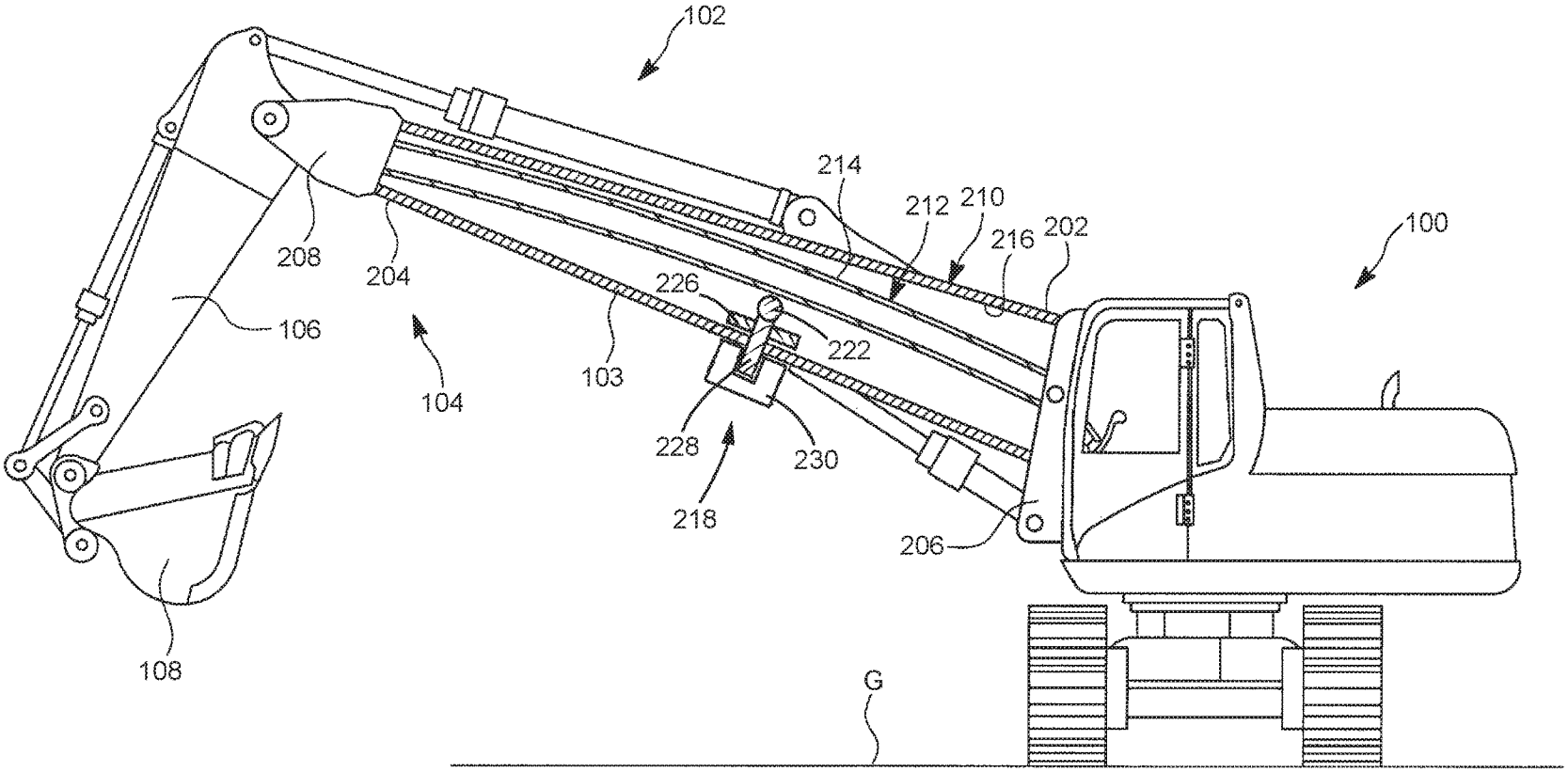
FIG. 5 is a side view of the machine of FIG. 1 including a movable pin disposed in contact with the inner shell and a hydraulic cylinder configured to move the movable pin.

FIG. 5 illustrates a cross-section of the load carrying member 104 of the machine 100, according to another embodiment of the present disclosure. The machine 100 includes much of the same construction as in the previous embodiment including a movable pin 222. The movable pin 222 may be mounted so as to be in contact with an underside of the inner shell 212. In this respect, the movable pin 222 may function like the fixed pin 220 shown in FIG. 3. The movable pin 222 may be selectively moved more inwardly of the boom 103 and apply a relatively increased amount of stress to the inner shell 212 or outwardly to reduce the amount of stress added to the inner shell. In one embodiment, the movable pin 222 is moved inwardly and outwardly of the boom 103 hydraulically. In one embodiment, the movable pin 222 is effectively the piston and is driven by a hydraulic cylinder 230. Alternatively, the hydraulic cylinder 230 includes a piston 228, as is well known, configured to respond to changes in hydraulic pressure within the hydraulic cylinder and the movable pin 222 is in contact with the piston and moved by motion of the piston.

Figure 7:
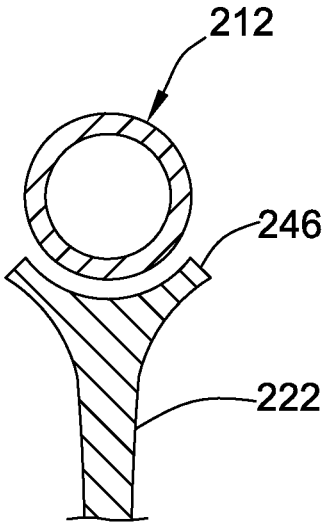
FIG. 7 is a cross section view of the inner shell and one embodiment of a pin.
Figure 8:
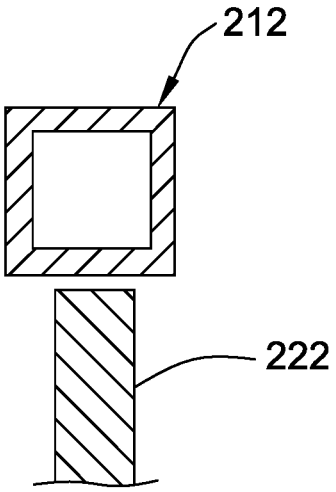
FIG. 8 is a cross section view of the inner shell and another embodiment of a pin.

The movable pin 222 may be cylindrical as shown in FIG. 8, or yoke shaped as shown in FIG. 7 or any suitable shape. In one embodiment, the movable pin 222 may be shaped and sized to fit closely to the cross section shape of the inner shell 212. If, for example, the inner shell 212 is cylindrical, the movable pin 222 may include a U or Y shaped terminal end 246 as shown in FIG. 7, which self-centers on the inner shell, preventing misalignment of the pin on the inner shell.

Returning to FIG. 5, movement of the movable pin 222 in or out of the boom 103 depends on the amount of pressure generated by the hydraulic cylinder 230 and the force in the reverse direction caused by the inner shell 212. Moving the movable pin 222 inwardly increases the stress on the inner shell 212 and conversely, moving the movable pin outwardly reduces the stress added to the inner shell.

Figure 6:
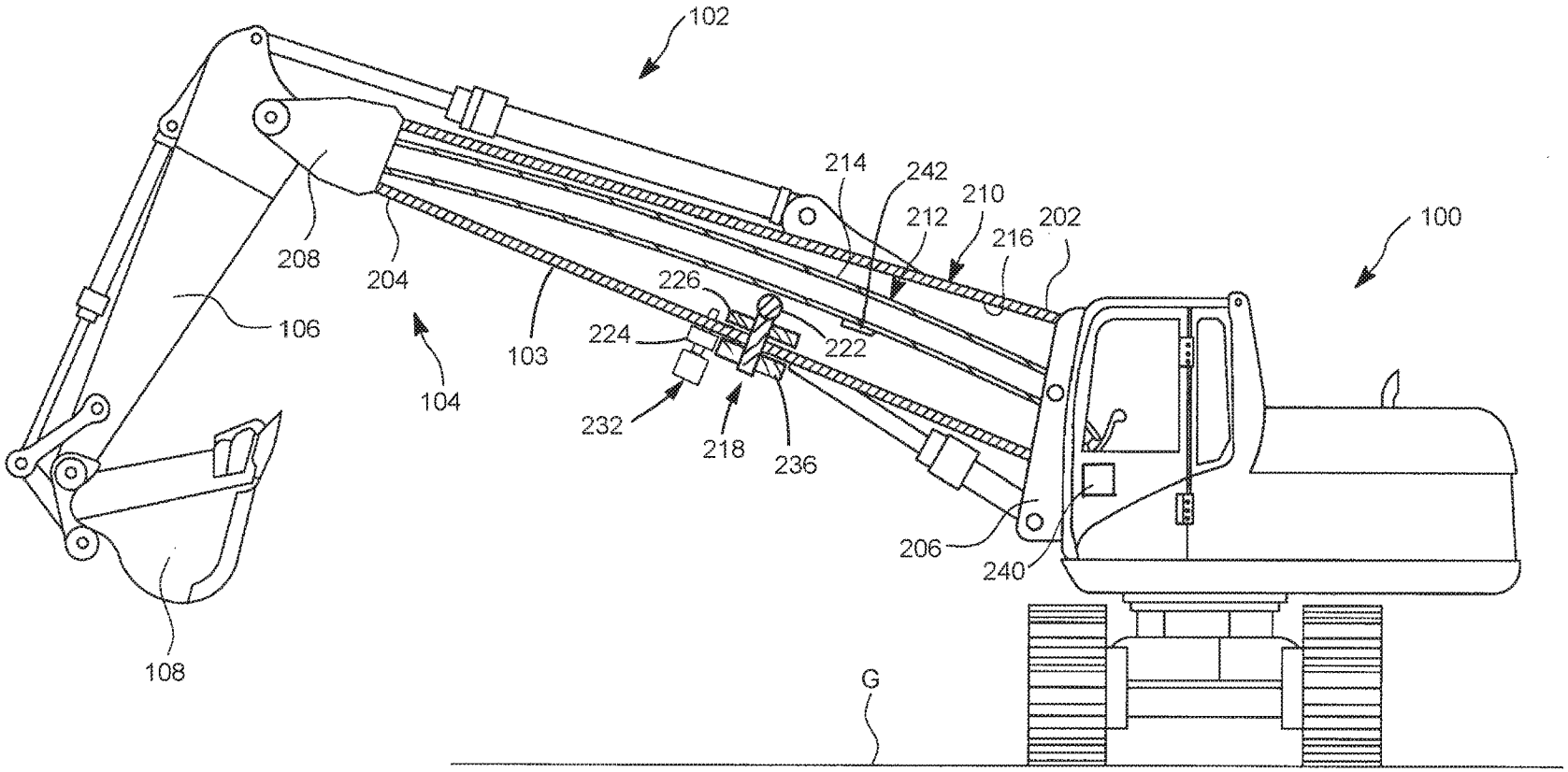
FIG. 6 is a side view of the machine of FIG. 1 including a movable pin disposed in contact with the inner shell and a motorized mechanism configured to move the movable pin.

FIG. 6 illustrates yet another embodiment of the movable pin 222 and a mechanism configured to adjust the position of the movable pin. The mechanism may include an electric or hydraulic motor 232 and an optional gear or gearbox 234. The gearbox 234 is configured to interact with a gear 236 attached to the movable pin 222 or directly with the movable pin to advance or rotate the pin and thereby move the movable pin inwardly and outwardly.

The embodiments of FIG. 5 and FIG. 6 may communicate with a controller 240 by wired or wireless connection. The controller 240 may be in communication with one or more sensor 242 for sensing conditions, for example conditions related to the load, on the inner shell 212. The sensors 242 may be strain gauges, pressure sensors, motion sensors, or other sensors used by the controller 240 to sense the condition of the inner shell 212, and alternatively also the outer shell 210, to generate signals to direct operation of the motor 232 and thus the position of the movable pin 222, and thereby causing adjustments of the stress added to the inner shell 212 during operation of the machine 100. The sensors 242 may also be used to monitor hydraulic pressure in lines operating the hydraulic actuators 120, 122, 124, and 126. The controller 240 monitors the pressure and when a selected threshold is exceeded, for example an increase in pressure of about from ten to about twenty percent, the pin 222 can be advanced, urged against the inner shell 212, to increase the bend rate of the inner shell and thus increase the bending moment/spring rate of the inner shell and thus stiffen the entire boom assembly 103.

The controller 240 may include a processor (not shown) and a memory component (not shown). The processor may be microprocessors or other processors as known in the art. In some embodiments the processor may be made up of multiple processors. The processor may execute instructions for changing fluid pressure within hydraulic cylinder 230 or the motion of the motor 232.

Such instructions may be read into or incorporated into a computer readable medium, such as the memory component or provided external to processor. Embodiments are not limited to any specific combination of hardware circuitry and software.

The term "computer-readable medium" as used herein refers to any medium or combination of media that participates in providing instructions to processor for execution. Such a medium may take many forms, including but not limited to, non-volatile media, volatile media, and transmission media. Non-volatile media includes, for example, optical or magnetic disks. Volatile media includes dynamic memory. Transmission media includes coaxial cables, copper wire and fiber optics.

Common forms of computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, a PROM, and EPROM, a FLASH-EPROM, any other memory chip or cartridge, or any other medium from which a computer or processor can read.

The memory component may include any form of computer-readable media as described above. The memory component may include multiple memory components.

The controller 240 may be enclosed in a single housing. In alternative embodiments, the controller may include a plurality of components operably connected and enclosed in a plurality of housings. In embodiments the controller 240 may be located in a plurality of operably connected locations including being fixedly attached to the machine 100. The controller 240 may be configured to sense, via the sensors 242, the load on inner shell 212 and generate a signal responsive to the sensed load.

For example, the controller 240, when sensing an increase in load on the inner shell 212, can cause an increase in stress on the inner shell by moving the movable pin 222 inwardly toward to the inner shell. Conversely, the controller 240, when sensing a decrease in load on the inner shell 212, can cause a decrease in stress on the inner shell by moving the movable pin 222 outwardly away from the inner shell.

Various embodiments disclosed herein are to be taken in the illustrative and explanatory sense, and should in no way be construed as limiting of the present disclosure.

INDUSTRIAL APPLICABILITY

The machine 100, during operation, exposes the boom 103 to varying loads dependent upon a number of factors including the position of the load carrying member 104 and the work being performed, for example. When the load carrying member 104 lifts the load from a first position to a second position, the inner shell 212 may be subjected to bending loads owing to the length of the load carrying member 104 and the work being performed. In such a scenario, the inner shell 212 bends at least due to the load and force acting on the work tool 108. When the load increases, the pin 220 in one embodiment, or the movable pin 222 in other embodiments, operates to increase the stress on the inner shell and thereby increases the effectiveness of the inner shell in lifting the load in combination with the outer shell 210.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A load carrying member for a machine, the load carrying member comprising:
- an outer shell having an inner wall;
- an inner shell disposed within the outer shell, the inner shell being configured according to a predetermined curvature within the outer shell whereby the inner shell is pre-stressed within the outer shell; and
- a pin disposed through the outer shell and having a distal end disposed in contact with the inner shell, the pin being movably disposed through the outer shell to move the distal end toward or away from the inner wall of the outer shell to increase or decrease a spring rate of the inner shell.

2. The load carrying member of claim 1, wherein the inner shell has an inner shell length and the outer shell has an outer shell length, the inner shell length being greater than the outer shell length, the inner shell having opposite ends coupled to the outer shell to produce the predetermined curvature within the outer shell.

3. The load carrying member of claim 2, wherein a cross-section of the inner shell comprises one of a rectangle, polygon, a circle, and an ellipse.

4. The load carrying member of claim 1, wherein the pin is fixed through the outer shell.

5. The load carrying member of claim 4, wherein the pin extends transversely through the outer shell.

6. The load carrying member of claim 1, wherein the pin is disposed underneath the inner shell.

7. The load carrying member of claim 1, wherein the pin is movably disposed through the outer shell by a threaded engagement therewith.

8. The load carrying member of claim 1, further comprising a hydraulic cylinder disposed on the outer shell and operatively connected to the pin, and configured to move the pin toward and away from the inner wall of the outer shell.

9. The load carrying member of claim 1, further comprising a motor and a gear disposed on the outer shell and operatively connected to the pin, and configured to move the pin toward and away from the inner wall of the outer shell.

10. The load carrying member of claim 1, wherein the pin includes a yoke portion configured to engage the inner shell.

11. A machine comprising:
- a frame; and
- a boom assembly coupled to the frame, the boom assembly comprising:
  - a work tool;
  - a stick coupled to the work tool; and
  - a load carrying member having a first end coupled to the frame and a second end coupled to the stick, the load carrying member comprising:
    - an outer shell having an inner wall;
    - an inner shell disposed within the outer shell, the inner shell being configured according to a predetermined curvature within the outer shell whereby the inner shell is pre-stressed within the outer shell; and
    - a pin disposed through the outer shell and having a distal end disposed in contact with the inner shell, the pin being movably disposed through the outer shell to move the distal end toward or away from the inner wall of the outer shell to increase or decrease a spring rate of the inner shell.

12. The machine of claim 11, wherein each of the first end and the second end of the load carrying member comprises an attachment fixture configured to couple the outer shell to the frame and the stick, respectively.

13. A boom assembly of a hydraulic excavator machine, the boom assembly comprising:
- a work tool;
- a stick coupled to the work tool; and
- a load carrying member having a first end coupled to a frame of the machine and a second end coupled to the stick, the load carrying member comprising:
  - an outer shell having an outer shell length;
  - an inner shell having an inner shell length and opposite ends, the inner shell length being greater than the outer shell length, the inner shell being disposed within the outer shell, the opposite ends of the inner shell being coupled to the outer shell to place the inner shell in compression within the outer shell and to produce a predetermined curvature within the outer shell whereby the inner shell is pre-stressed within the outer shell; and
  - a pin disposed through the outer shell and in contact with the inner shell and configured to increase a spring rate of the inner shell.

14. The boom assembly of claim 13, wherein a cross-section of the outer shell comprises one of a rectangle, polygon, a circle, and an ellipse.

15. The boom assembly of claim 14, wherein a cross-section of the inner shell comprises one of a rectangle, polygon, a circle, and an ellipse.

16. The boom assembly of claim 13, wherein the pin is fixed through the outer shell.

17. The boom assembly of claim 16, wherein the pin extends transversely through the outer shell.

18. The boom assembly of claim 13, wherein the pin is disposed underneath the inner shell.

19. The boom assembly of claim 13, wherein the pin is movably disposed through the outer shell.

* * * * *